United States Patent [19]

Yee

[11] Patent Number: 4,478,774

[45] Date of Patent: Oct. 23, 1984

[54] METHOD FOR REPAIRING HEELS OF SHOES

[76] Inventor: Tin B. Yee, 719 Erskine St., N.W., Huntsville, Ala. 35805

[21] Appl. No.: 431,239

[22] Filed: Sep. 30, 1982

[51] Int. Cl.[3] ..... B29C 5/00; B29C 11/00

[52] U.S. Cl. ..... 264/36; 156/184; 156/185; 156/245; 156/247; 264/219

[58] Field of Search ..... 264/36, 219; 249/127, 249/135; 525/184; 524/315; 156/184, 185, 245, 247

[56] References Cited

U.S. PATENT DOCUMENTS

| | | | |
|---|---|---|---|
| 2,810,935 | 10/1957 | Gaydebouroff | 264/219 |
| 2,947,033 | 8/1960 | Ryan | 264/36 |
| 3,261,901 | 7/1966 | Kopp | 264/219 |
| 3,647,862 | 3/1972 | Hoffman et al. | 524/315 |
| 3,701,702 | 10/1972 | Schichman et al. | 525/184 |
| 3,969,568 | 7/1976 | Sperley | 525/184 |

*Primary Examiner*—Willard E. Hoag

[57] ABSTRACT

A method for repairing worn heels of shoes, which is comprised of a mold built on the worn part of the heel with a strip of aluminum foil on the sticky side of an adhesive tape that is adhered to the curved wall on the side of the heel to be repaired, for the repairing material to be poured into there. A repairing material, comprising of a synthetic rubber, butadienestyrene, dissolved in the organic solvent mixture which is comprised of toluene, xylene, and amyl acetate, mixed with aramid fibers of various sizes, and a coloring material in a fluid mass for repairing worn heels and tears on straps and bands of shoes.

1 Claim, 2 Drawing Figures

METHOD FOR REPAIRING HEELS OF SHOES

This invention relates to a method of repairing worn heels and tears on straps and bands of shoes and similar articles. This invention likewise relates to products adapted with this method to be used for repairing worn heels and tears on straps and bands of shoes.

An object of the invention is to provide a method and products by which the ordinary individual may repair worn heels and tears on straps and bands of shoes, without the use of special technical skill and without the use of apparatus or equipment or facilities not readily at hand.

Another object of the invention is to provide a product that has a good wearing resistance and good resilient property on heels and high strength to hold together the tears on straps and bands of shoes.

Yet another object of the invention is to provide a product that can be dried and develop strength over night, so the individual can wear the shoes the next morning after he or she has used the method and products to repair the shoes, the evening before.

Yet still another object of the invention is to provide a product that has a pleasant odor rather than an objectable odor to the user when repairing shoes.

The way that many people walk is that they put the edge of the heel of the shoes down on the floor first and then follow by the bottom of the heel and the sole on the floor. This way, the edge of the heel of the shoes is worn faster than the other parts of the heel and sole. The worn out part of the heels usually ends up in a wedge shape. If the worn out wedge shape edge on the heels is not repaired, it will eventually affect the posture of the wearer when walking with such shoes. It is important for a person to repair this type of damage on the heels of the shoes as often as needed, economically, easily, and conveniently.

A present method of repairing this kind of damage on the edge of the heel is by replacing the worn out ones with a new pair of heels. This method is expensive and inconvenient. Another present method of repairing the worn out edge of the heels is to put some liquid rubber or plastic rubber on the worn out place. This method cannot restore the damaged heels back to their original shape. When the liquid rubber or plastic rubber dries on the heels, it gives an unattractive appearance. Besides this, the liquid rubber or plastic rubber does not have a good wearing resistance.

The present invention provides a method and material for repairing the worn out edge of the heels. The method calls for a mold to be built on the worn out edge of the heel, after the worn out edge surface has been cleaned and roughtened with a piece of sand paper. The mold, formed by a strip of aluminum foil (thickness from less than a mil to several mils) on the sticky side of an adhesive tape (masking tape, Scott's tape, etc.), which is adhered to the wall on the side of the heel to be repaired. The aluminum foil strip should be large enough to cover the area of the worn out part and also the area about a quarter of an inch beyond the edges of the worn out part of the heel. When forming the mold with the adhesive tape on the wall of the heel, the upper edge of the aluminum foil strip should be extended about a quarter of an inch above the level surface of the bottom of the heel, when the shoe is held with the bottom side of the heel up.

The adhesive tape should be larger than the aluminum foil strip. When the aluminum foil strip is placed on the sticky side of the adhesive tape, the left, right, and the lower edges of the adhesive tape should be extended to more than a quarter of an inch from the corresponding edges of the aluminum foil strip.

To form the mold on the worn out edge of the heel, the assembly of the aluminum foil strip on the sticky side of the adhesive tape is adhered firmly to the curved wall on the side of the heel to be repaired, with the upper edge of the adhesive tape extending about an eighth of an inch above the level surface of the bottom of the heel, when the shoe is held with the bottom side of the heel up.

Figure 1:
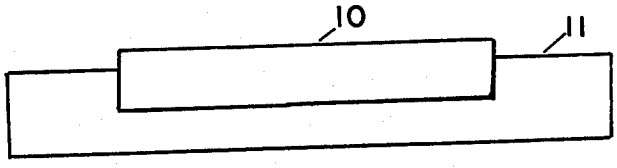
FIG. 1 shows the strip used to form the mold of the invention.

The drawing in FIG. 1 shows the position of the aluminum foil strip 10, with respect to the position of the adhesive tape 11, when the aluminum foil strip is placed on the sticky side of the adhesive tape. The drawing in FIG. 1 also shows the left, right, and the lower edges of the adhesive tape to be extending more than a quarter of an inch from the corresponding edges of the aluminum foil strip, while the upper edge of the aluminum foil strip is entending about an eighth of an inch above the corresponding edge of the adhesive tape.

Figure 2:
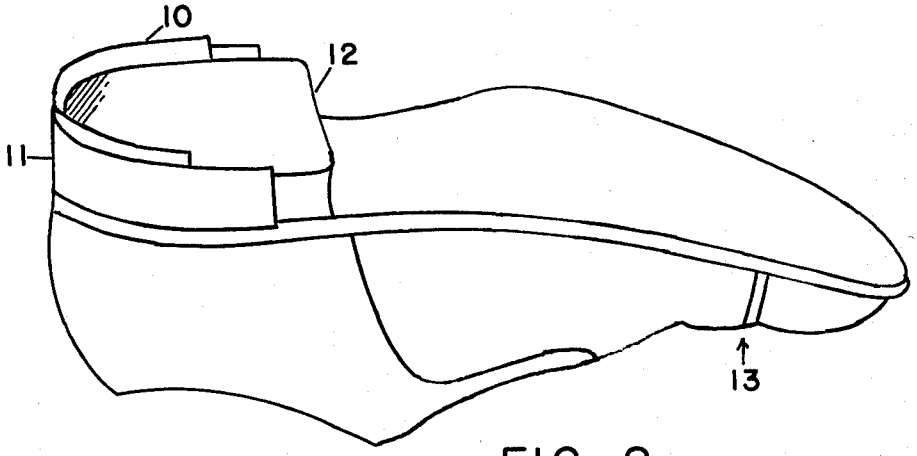
FIG. 2 shows how the strip is used to form a mold about the heel of a shoe.

The drawing in FIG. 2 shows how the mold is built on the worn out edge of the heel. The assembly of the aluminum foil strip 10, on the sticky side of the adhesive tape 11, is adhered firmly on the curved wall of the heel 12, of the shoe 13. The drawing shows the positions of the aluminum foil strip, the adhesive tape, and the heel with respect to themselves. When the shoe is held with its bottom side up, the upper edge of the aluminum foil strip should be about a quarter of an inch above the level surface of the bottom of the heel, while the upper edge of the adhesive tape should be about an eighth of an inch above the level surface of the bottom of the heel.

When a tear is developed on a strap or band of the shoe, particularly sandals, a repair is needed in order to extend the life of the shoes. A present method for repairing such tears is to sew some threads over the tears to hold the straps or bands together or to secure them to the shoes. This method is expensive and inconvenient to the wearer. The sewing around the tears may weaken the spot because of too many needle holes. Another present method for repairing the tears on the straps and bands of the shoes is to glue the tears together with or without a reinforcing material over the tears. Without a reinforcing material over the tears, the glued splice on the strap or band will not be strong. With a reinforcing material over the tears, the glued splice with a reinforcing material on it will appear unattractive.

The present invention provides a method and material for repairing such tears on the straps and bands of the shoes, easily, economically, conveniently, and with little alternation in the original appearance of the shoes. The material is a good adhesive and has elastic property. It contains a recent developed strong aramid fiber, such as Du Pont Kelvar, which is used in the automobile tires and in the bullet proof vest. Shoes, particularly women's shoes, come in many colors. The present invention permits the user to choose the color that matches the color of his shoes by allowing him to add the coloring material to the composition and mix well before it is used to repair the shoes.

The present invention provides a composition that is adaptable to repair the heels, straps, and bands of shoes. A typical composition of the repairing material is as follows:

Synthetic rubber, butadiene-styrene—100 grams
Organic solvent mixture—30-35 ml.
Aramid fibers—5-10 grams
Coloring material—2-30 grams The synthetic rubber, butadiene-styrene, is dissolved in the organic solvent mixture. A coloring material may be added to the composition at this time or later. The aramid fibers of various sizes are then added to the composition and mixed well before use.

A typical organic solvent mixture by volume is as follows: 82 parts of toluene, 15 parts of xylene, and 3 parts of amyl acetate (banana oil). Xylene has a higher boiling point than the toluene. It is advantageous to have a high boiling point organic solvent mixture. Amyl acetate is added to the composition of the repairing material to give a pleasant odor to the user when he repairs his shoes.

Examples of the synthetic rubber, butadiene-styrene, used are: Shell Chemical Company, Kraton D-1101; Firestone Synthetic Rubber and Latex Company, FR-S 1502 and FR-S 1513; and BF Goodrich Chemical Group, Ameripol 4616.

An example of the aramid fiber used is the Du Pont Kelvar fiber. It has a good resistance to wear when it is used in the repairing material for the heels. It has a high strength to hold the tears together or to secure the loose straps and bands on to the shoes when it is used in the repairing material. The repairing material should contain several different sizes of aramid fibers, such as 1/16, $\frac{1}{8}$, $\frac{1}{4}$, etc. of an inch. If the repairing material is intended for repairing heels only, aramid fiber size up to a quarter of an inch will be sufficient. But if the repairing material is also for repairing the tears on straps and bands of the shoes, some of the aramid fibers in the repairing material must be over a quarter of an inch.

Coloring material used in the repairing material can be organic or inorganic pigments or organic dyes. The coloring materials have different covering or masking power. The amount of coloring materials used in a batch of repairing material is depending on their covering or masking power. Some coloring materials, such as carbon black, can be used as a filler as well as coloring. This invention provides a method, whereby the user can add the coloring materials to the repairing material to match the color of his shoes before he uses it to repair his shoes. Examples of coloring materials used are: titanium dioxide for white color, carbon black for black color, and blending of two or more coloring materials, such as titanium dioxide and iron oxide to give a tan color.

Coloring materials can be obtained from commercial establishments, such as Harshaw Chemical Co., Color Division of Ferro Corp., Pigment Department of the Du Pont de Nemours and Co., and Sherwin Williams Colorants and Chemicals.

To repair the worn part of the heel of the shoe, the shoe is placed on the top of a level surface with its bottom side up. Crushed newspaper may be placed under the shoe to make the bottom of the shoe level. A mold is built on the worn part of the heel as described elsewhere in this patent application. The repairing material is poured into the mold with the help of a wooden stick to direct where it should go until the repairing material comes up to just a little above the level surface of the bottom of the heel. The little extra repairing material poured into the mold is to compensate the shrinkage when the repairing material dried. The repairing material will be dried over night, so the user can use his shoes the next morning. A thick layer of repairing material may take more than a day to dry. When the repairing material is dried, the form of the mold may be taken off, for the aluminum foil will not adhere to the dried repairing material.

To repair the tears on the straps and bands of the shoes, choose a coloring material which when added to the repairing material will produce a color that will match the color of the shoes to be repaired. Then add this coloring material to the repairing material. Mix the coloring material and repairing material well before use. The repairing material is placed around the tears with the help of a wooden stick. When the repairing material has dried, it will hold the tears together on the straps and bands or it will hold the loose straps and bands on to the shoes.

Since certain changes may be made in the above methods and material without the departing from the scope of the invention herein involved, it is intended that all matter contained in the above description, or shown in the accompanying drawing, shall be interpreted as illustrative and not in a limiting sense.

What is claimed is:

1. A method of repairing the worn down rear edge of a heel in situ on an inverted shoe heel by forming a mold cavity with a strip of adhesive tape, which has a smaller strip of aluminum foil attached to a portion of its sticky side, said aluminum foil strip being large enough to cover the worn down rear edge area of the heel and also being used to facilitate the removal of the adhesive tape from the cured and dried repairing material, said method comprised of forming said mold cavity by wrapping said aluminum foil side of said adhesive tape assembly around the rear curved side of the heel to cover the worn down rear edge area; extending the adhesive tape assembly horizontally and vertically a little beyond the worn down rear edge area to form said mold cavity, thereby conforming to the shape of the original rear edge of the heel; introducing into said mold cavity and filling said mold cavity to the same level or height as the surface of the heel, a fluid mass of repairing material, comprised of a synthetic rubber, butadiene-styrene, in an organic solvent mixture, containing aramid fibers of varied sizes and a coloring material, said organic solvent mixture comprised of amyl acetate, xylene, toluene, aramid fibers, and coloring material, said amyl acetate being present up to about 3% by volume of said solvent, said xylene being several times more than the volume of amyl acetate and up to about 15% by volume of said solvent, and said toluene being several times more than the volumes of xylene and up to about 82% by volume of said solvent, said aramid fibers being of varied sizes with lengths less than an inch, said coloring material consisting of organic or inorganic dyes; allowing said repairing material to cure and dry; and removing said adhesive tape and aluminum foil by peeling.

* * * * *